United States Patent [19]

Farmer

[11] 4,071,995

[45] Feb. 7, 1978

[54] WALL CONSTRUCTION MEMBER

[76] Inventor: Melville E. Farmer, 2551 Crestview Drive, Newport Beach, Calif. 92660

[21] Appl. No.: 453,496

[22] Filed: Mar. 21, 1974

Related U.S. Application Data

[63] Continuation of Ser. No. 296,126, Oct. 10, 1972, abandoned.

[51] Int. Cl.[2] ..... E04C 3/32

[52] U.S. Cl. ..... 52/729; 52/732

[58] Field of Search ..... 52/730–732, 52/484, 489, 487, 729, 495, 758 D, 346

[56] References Cited

U.S. PATENT DOCUMENTS

| | | | |
|---|---|---|---|
| 760,321 | 5/1904 | Edwards | 52/758 D |
| 1,826,133 | 10/1931 | Hatch | 52/732 |
| 1,853,090 | 4/1932 | Smiley | 52/730 |
| 2,066,205 | 12/1936 | Keating | 52/732 |
| 2,394,443 | 2/1946 | Guignon | 52/468 |
| 2,522,097 | 9/1950 | Cookson | 29/453 |
| 3,303,627 | 2/1967 | Mora | 52/730 |
| 3,714,753 | 2/1973 | Jahn | 52/484 |
| 3,729,883 | 5/1973 | Thompson | 52/496 |

*Primary Examiner*—James L. Ridgill, Jr.
*Attorney, Agent, or Firm*—Lyon & Lyon

[57] ABSTRACT

A pair of generally T-shaped runners, each including first and second flanges and a spline, are joined together forming an H-shaped wall construction member. When assembled, each flange is connected to a wall member and a plurality of spaced interconnecting clips are formed between the splines of the pair of runners. The interconnecting clips allow the runners to be readily assembled by sliding the runners together in the horizontal or vertical directions and readily disassembled by sliding the runners apart in the vertical direction.

6 Claims, 3 Drawing Figures

WALL CONSTRUCTION MEMBER

This is a continuation, of application Ser. No. 296,126, filed Oct. 10, 1972, now abandoned.

BACKGROUND OF THE INVENTION

This invention relates to versatile wall construction members utilized in building construction to form an interior movable wall member of a material such as a gypsum board or wall paneling. More particularly, this invention relates to demountable walls i.e., walls which may readily be assembled and disassembled to permit the rearrangement or reconstruction of a room or to permit a wall to be salvaged for reuse in other locations.

A common structure for demountably securing a wall member utilizes a member having slots of a particular configuration thereon, which is adapted to receive a stud from a companion member. Structures of this type are exemplified in U.S. Pat. No. 3,256,666.

Another structure utilizes clips wherein the clips are engaged in a slot or companion channel to form a wall member. U.S. Pat. No. 2,066,205 is typical of these prior art snap fit securing structures.

The instant invention improves on the prior art structures in that it provides for easy-to-manufacture generally T-shaped integrally formed runners which by a plurality of spaced interconnecting clips allow wall members to be readily assembled by sliding the runners either horizontally or vertically and readily disassembled by sliding the runners vertically.

SUMMARY OF THE INVENTION

It is an object of this invention to provide an H-shaped wall construction member comprising a pair of generally T-shaped integrally formed runners which allow the ready assembly and removal of wall members by sliding the runners together horizontally or vertically and ready disassembly by sliding the runners apart vertically.

It is another object of this invention to provide a wall construction member for demountable walls with an ease of manufacture and installation providing low field cost and simplicity.

It is a further object of this invention to provide an improved wall construction member which may very quickly and easily be assembled and removed with a minimum of skilled labor and which is entirely salvageable and reusable.

Briefly stated, and according to one aspect of this invention, the foregoing objects are achieved by providing an H-shaped wall construction member comprising two generally T-shaped runners, each runner having first and second flanges and a spline. The first spline includes integrally formed spaced snap members which will form an interconnecting clip with integrally formed spaced tab members in the second spline when assembled. The interconnecting clip is formed by sliding the runners together, in the horizontal or vertical directions.

BRIEF DESCRIPTION OF THE DRAWINGS

The invention both as to its organization and principle of operation together with further objects and advantages thereof may better be understood by referring to the following detailed description of an embodiment of the invention when taken in conjunction with the accompanying drawings in which.

DESCRIPTION OF THE PREFERRED EMBODIMENT

Figure 1:
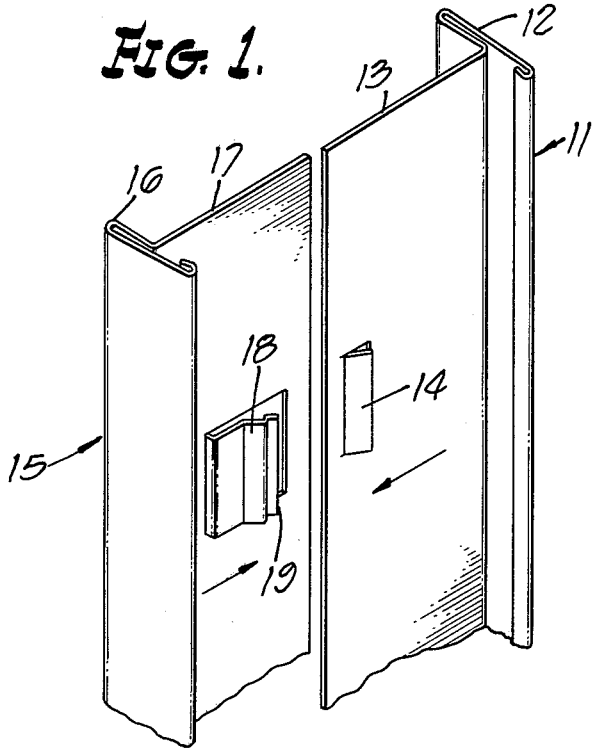
FIG. 1 is a perspective view of a pair of T-shaped runners being assembled in the horizontal direction, in accordance with this invention.

Referring now to FIG. 1, a generally T-shaped runner 11 is illustrated to comprise first and second flanges 12 12 and a blade or spline 13, said flanges extending substantially perpendicularly from one end of said spline in opposite directions therefrom. The flanges 12 are adapted to be secured to wall members, such as gypsum boards, and are folded from a common piece of material, such as aluminum, to form the spline 13.

A plurality of tab members such as tab member 14 are formed from the spline 13 and are spaced along the length of the spline 13, preferably at equal intervals such as 1 foot apart. The tab members are integrally attached in the horizontal assembly direction to a joining side of the spline 13 and are disposed from the plane of spline 13 to form edges in the vertical assembly direction, and to form a projection in the direction of a horizontal assembly as indicated by the arrows in FIG. 1.

A generally T-shaped runner 15, comprising flanges 16 folded from a common piece of material such as aluminum to form a spline 17, is a companion member to runner 11. A plurality of resilient snap members such as snap member 18 are integrally formed and disposed from the plane of a joining side in the vertical assembly direction of the spline 17 to form vertical assembly edges. The snap members are spaced along the length of the spline 17 at intervals which correspond to those of the corresponding tab members on spline 13, once assembled. Snap member 18 includes an integrally formed lip 19 forming a horizontal assembly direction edge which will allow the forming of an interconnecting clip when the snap member slides either horizontally or vertically over the tab member. This lip 19 prevents the runners from being readily disassembled in the horizontal disassembly direction, thereby providing a wall with superior stability in that the risk of unwanted disassembly in the horizontal disassembly direction is substantially eliminated.

If necessary, disassembly or removal in the horizontal direction can be accomplished. This is done inserting a thin blade or the like beneath the joining side of each snap member 18 and raising the snap member the required clearing distance such as approximately one inch, to allow the lip 19 to disengage from the edge of the tab member 14.

Figure 2:
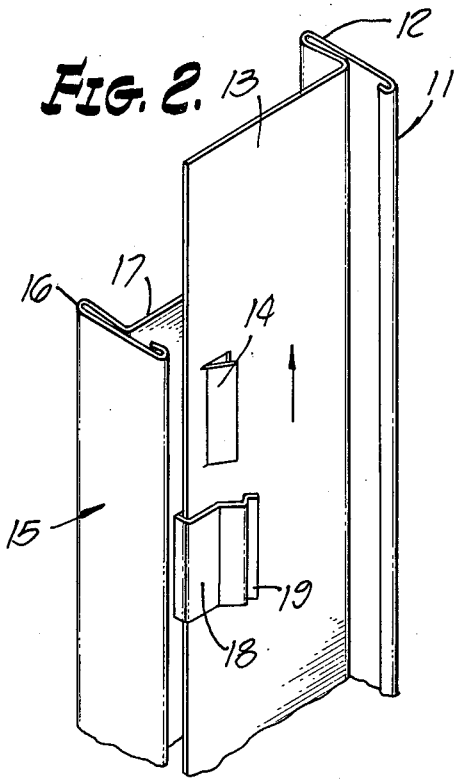
FIG. 2 is a perspective view of a pair of T-shaped runners being assembled or removed in the vertical direction in, accordance with this invention.

FIG. 2 illustrates the generally T-shaped runner 15 with the integrally connected snap member 18 each including a lip 19 being disengaged in the direction of the arrow from the generally T-shaped runner 11 by moving the runner 11 in the vertical direction and thereby sliding out the tab member 14 from the confines of the snap member 18 with the lip 19.

When assembly is desired, the two generally T-shaped runners 11 and 15 may be snapped together in the horizontal assembly direction as illustrated in FIG. 1 or they may be vertically assembled reversing the procedure of FIG. 2 i.e. by sliding the tab members such as tab member 14 under the snap member such as snap member 18 in the vertical assembly direction to form a series of interconnecting clips.

Thus, the projection of each tab member, such as tab member 14, is disposed from the plane of the appropriate or joining side of spline 13 to engage with the snap members, such as snap member 18, disposed from the plane of the appropriate joining side of spline 17 to form a series of interconnecting clips when assembled, and each snap member 18 of generally T-shaped runner 15 is thus disposed from the plane of a joining side of spline 17 to allow ready assembly in both the horizontal and vertical assembly directions and ready disassembly in the vertical disassembly direction, while preventing ready disassembly in the horizontal disassembly direction.

Figure 3:
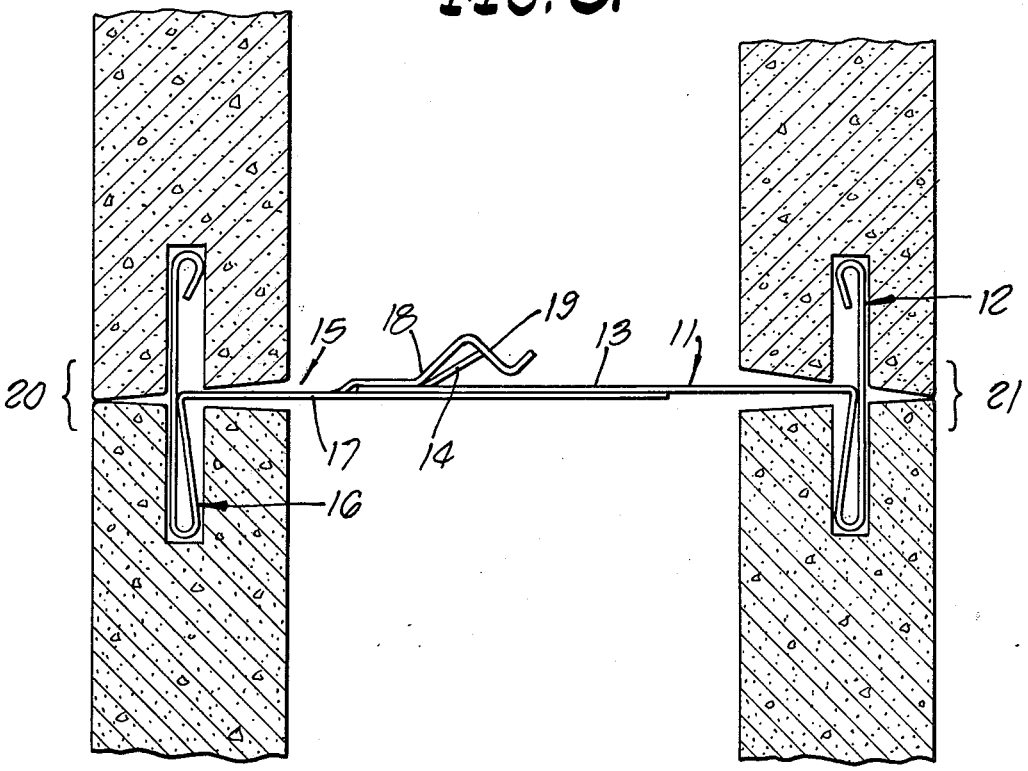
FIG. 3 is a top view of an assembled wall construction member in accordance with this invention.

FIG. 3 is illustrative of a completed H-shaped wall construction member attached to wall members 20. The wall members 20 may be constructed of gypsum board in a manner well known in the art. The embodiment in FIG. 3 illustrates the flanges 16 of the generally T-shaped runner 15 as being mounted internally in the wall members 20. Likewise, the flanges 12 of the generally T-shaped runner 11 are mounted internally in the wall member 20. The H-shaped wall construction member of the instant invention may be secured to many types of wall members to provide a variety of wall facings and finishes. Further, the H-shaped construction member of this invention is compatible with a variety of joint treatments such as V-joints, concealed joints or exposed joints. The H-shaped construction member is also versatile and may be secured to wall members by various techniques such as slotting the wall members to hold and conceal the flanges, or passing the flanges through a slot in the wall member to attach the flanges outside the wall member.

FIG. 3 also illustrates a top view of the connected interconnecting clip formed by the snap member 18 with the lip 19 extending from the spline 17 of generally T-shaped runner 15 and the tab member 14 formed from the spline 13 of generally T-shaped runner 11. Because of the uniqueness of the H-shaped wall construction member, the wall may be assembled with two sides, or one side erected to allow access to attach the second generally T-shaped runner at a later time.

By providing a pair of generally T-shaped runners with a plurality of snap or tab members thereon, and with each runner formed from a common piece of material, an ease of cost and manufacturing is achieved. Further, the unique H-shaped wall construction member formed when the runners are assembled provides for ease of assembly in both the horizontal and vertical assembly assembly directions and ease of disassembly in the vertical disassembly direction with substantial prevention of disassembly in the horizontal disassembly direction. However, if it is necessary to disassemble the runners in the horizontal disassembly direction, this can be done as discussed earlier by raising the snap members away from the tab members.

While embodiment and applications of this invention have been shown and described, it will be apparent to those skilled in the art that many more modifications are possible without departing from the inventive concepts herein described. The invention, therefore, is not to be restricted except as is necessary by the prior art and by the spirit of the appended claims.

What is claimed as new and desired to be secured by Letters Patent of the United States is:

1. A wall construction member comprising:

a first generally T-shaped runner having a spline and first and second flanges extending outwardly from the plane of said spline from one end of said spline in opposite directions therefrom;

a second generally T-shaped runner having a spline and first and second flanges extending outwardly from the plane of said spline from one end of said spline in opposite directions therefrom; and a clip means for securing said spline of said first runner to said spline of said second runner such that said runners are capable of being readily assembled in the vertical assembly direction and also in the horizontal assembly direction, and capable of being readily disassembled in the vertical disassembly direction, and prevented from being readily disassembled in the horizontal disassembly direction, and wherein said clip means comprises:

a plurality of resilient snap members on said spline of said first runner, spaced along the length of said spline, each of said snap members being attached to said spline along a line substantially parallel to the plane of said first and second flanges of said first runner and being displaced from said spline, extending in a direction generally away from said flanges of said first runner such that said snap member has three edges unattached to said spline, two substantially perpendicular to said attachment line and one substantially parallel thereto, with said snap member having a lip element near its one unattached edge which is substantially parallel to said attachment line, said lip element being adapted to receive and secure a tab member; and a plurality of tab members on said spline of said second runner and spaced along the length of said spline, each of said tab members corresponding to a different one of said snap members and being attached to said spline along a line substantially parallel to the plane of said flanges of said second runner and being displaced from said spline, extending in a direction generally toward said flanges of said second runner such that said tab member has three edges unattached to said spline, two substantially perpendicular to said attachment line and one substantially parallel thereto, and thereby forms a projection capable of being received by each of said snap members, said projection capable of preventing said first and second runners from being readily disassembled in the horizontal disassembly direction, each of said snap members and corresponding tab members forming an interconnecting clip when said first runner and said second runner are assembled, said first and second runners capable of being readily assembled in the horizontal and vertical assembly directions, and capable of being readily disassembled in the vertical disassembly direction.

2. A wall construction member for use with wall members to provide a readily assembled and disassembled wall comprising:

a first generally T-shaped runner having a spline and first and second flanges extending outwardly from the plane of said spline from one end of said spline in opposite directions therefrom, said first flange capable of being received by the first one of the wall members, said second flange capable of being received by the second one of the wall members, such that the attached edges of the first and second wall members are adjacent, forming at least a portion of one side of the wall;

a second generally T-shaped runner having a spline and first and second flanges extending outwardly from the plane of said spline from one end of said spline in opposite directions therefrom, said first flange capable of being received by the third one of the wall members, said second flange capable of being received by the fourth one of the wall members, such that the attached edges of the third and fourth wall members are adjacent, forming at least a portion of the other side of the wall; and a clip means for securing said spline of said first runner to said spline of said second runner.

3. A wall construction member as in claim 2 wherein said clip means comprises:

a plurality of resilient snap members on said spline of said first runner, spaced along the length of said spline; and a plurality of tab members on said spline of said second runner, spaced along the length of said spline, each of said tab members corresponding to a different one of said snap members, with each of said corresponding snap members and tab members forming an interconnecting clip when said first generally T-shaped runner and said second generally T-shaped runner are assembled.

4. A wall construction member for use with wall members to provide a readily assembled and disassembled wall comprising:

a first generally T-shaped runner having a spline and first and second flanges extending outwardly from the plane of said spline from one end of said spline in opposite directions therefrom, said first flange capable of being received by the first one of the wall members, said second flange capable of being received by the second one of the wall members, such that the attached edges of the first and second wall members are adjacent, forming at least a portion of one side of the wall;

a second generally T-shaped runner having a spline and first and second flanges extending outwardly from the plane of said spline from one end of said spline in opposite directions therefrom, said first flange capable of being received by the third one of the wall members, said second flange capable of being received by the fourth one of the wall members, such that the attached edges of the third and fourth wall members are adjacent, forming at least a portion of the other side of the wall; and a clip means for securing said spline of said first runner to said spline of said second runner such that said runners are capable of being readily assembled in the vertical assembly direction and also in the horizontal assembly direction, and capable of being readily disassembled in the vertical disassembly direction, and prevented from being readily disassembled in the horizontal disassembly direction.

5. A wall construction member as in 4 wherein said clip means comprises:

a plurality of resilient snap members on said spline of said first runner, spaced along the length of said spline, each of said snap members being attached to said spline along a line substantially parallel to the plane of said first and second flanges of said first runner and being displaced from said spline, extending in a direction generally away from said flanges of said first runner such that said snap member has three edges unattached to said spline, two substantially perpendicular to said attachment line and one substantially parallel thereto, with said snap member having a lip element near its one unattached edge which is substantially parallel to said attachment line, said lip element being adapted to receive and secure a tab member; and a plurality of tab members on said spline of said second runner and spaced along the length of said spline, each of said tab members corresponding to a different one of said snap members and being attached to said spline along a line substantially parallel to the plane of said flanges of said second runner and being displaced from said spline, extending in a direction generally toward said flanges of said second runner such that said tab member has three edges unattached to said spline, two substantially perpendicular to said attachment line and one substantially parallel thereto, and thereby forms a projection capable of being received by each of said snap members, said projection capable of preventing said first and second runners from being readily disassembled in the horizontal disassembly direction, each of said snap members and corresponding tab members forming an interconnecting clip when said first runner and said second runner are assembled, said first and second runners capable of being readily assembled in the horizontal and vertical assembly directions, and capable of being readily disassembled in the vertical disassembly direction.

6. A wall construction process wherein the steps comprise:

affixing a first generally T-shaped runner, having a spline and first and second flanges extending outwardly from the plane of said spline from one end of said spline in opposite directions therefrom, to a first wall member by said first flange of said first runner;

affixing said first runner to a second wall member by said second flange of said first runner;

affixing a second generally T-shaped runner, having a spline and first and second flanges extending outwardly from the plane of said spline from one end of said spline in opposite directions therefrom, to a third wall member by said first flange of said second runner;

affixing said second runner to a fourth wall member by said second flange of said second runner; and clipping said spline of said first runner to said spline of said second runner such that said flanges of said first runner directly oppose said flanges of said second runner with said splines situated therebetween.

* * * * *